United States Patent [19]

Budmiger

[11] Patent Number: 4,597,450

[45] Date of Patent: Jul. 1, 1986

[54] FIRE-PROOF COVER AND ITS USE

[76] Inventor: Hermann Budmiger, Muhlematt 114, CH-4206 Seewen, Switzerland

[21] Appl. No.: 619,594

[22] PCT Filed: Feb. 22, 1983

[86] PCT No.: PCT/CH82/00018

§ 371 Date: May 25, 1984

§ 102(e) Date: May 25, 1984

[87] PCT Pub. No.: WO84/01301

PCT Pub. Date: Apr. 12, 1984

[30] Foreign Application Priority Data

Sep. 27, 1982 [CH] Switzerland ..... 5669/82

[51] Int. Cl.[4] ..... B65D 85/00; A62C 7/00

[52] U.S. Cl. ..... 169/50; 169/49; 206/610; 206/611

[58] Field of Search ..... 169/49, 50; 428/432, 428/920; 206/610-612

[56] References Cited

U.S. PATENT DOCUMENTS

| | | | |
|---|---|---|---|
| 2,183,113 | 12/1939 | Bennett | 169/50 |
| 2,720,269 | 10/1955 | Diacos | 169/50 |
| 3,171,581 | 3/1965 | Kugler | 383/906 |
| 4,269,901 | 5/1981 | Chamberlain | 169/50 |

FOREIGN PATENT DOCUMENTS

| | | |
|---|---|---|
| 983439 | 2/1975 | Canada . |
| 2237104 | 2/1973 | Fed. Rep. of Germany . |
| 2058832 | 3/1971 | France . |
| 2028390 | 5/1980 | United Kingdom . |

*Primary Examiner*—John E. Kittle
*Assistant Examiner*—James J. Seidleck
*Attorney, Agent, or Firm*—McCormick, Paulding & Huber

[57] ABSTRACT

The fire-proof cover has a high melting point, is flame-proof and at least almost gas tight. It is preferably made of glass thread fabric and may also be provided with an aluminum sheet. It is possible to make fire-proof a fabric by impregnation and it can be metallized under vacuum. The fire-proof cover is preferably provided with handling bands on its upper edge and it is folded so as to form a packet which is arranged in a package to be used as a fire protection assembly. The handling bands are projecting from one side of the package. The ends of the handling bands are detachably connected at the outer surface of the package. The package is provided with weakening lines. By pulling the handling bands, the package may be opened and the fire-proof cover may be unfolded so as to be ready for use.

5 Claims, 15 Drawing Figures

FIRE-PROOF COVER AND ITS USE

The invention relates to a fire-proof cover as well as to its use.

The combat of small local fires is of a significant economical importance since these are often the origin of large fires which not seldom result in losses in the millions. Whereas in businesses and industries and government offices extinguishing devices generally stand ready for use, such extinguishing devices are entirely unsuitable, for example, in households since such extinguishing devices are expensive and difficult to manipulate. Moreover, such extinguishing devices lead to many secondary damages such as water damage, soiling and destruction caused by the chemical extinguishing agent or the like.

Accordingly, it is an object of the present invention to provide a fire-protection set comprising a fire-protection cover or blanket which has a high melting point, is flame-proof, and is substantially impermeable to gas, which can effectively smother a small fire because the cover cuts off the supply of oxygen to the fire, and which does not cause any secondary damage as a result of its use.

It is a further object to provide a fire-protection set which can be stored, for example, hung up, wherever small fires are possible.

A still further object is to provide a fire-protection set in which a fire-protection cover can be released from a container in seconds, ready for use.

Accordingly, one broad aspect of this invention resides in providing a fire-protection set characterized by a fire-protection cover made of a glass-fibre fabric substantially impermeable to gas, the said fabric being cut to a rectangle, provided with gripping tapes at adjacent corners and folded into a bundle or packet, and also comprising a bag-like container one narrow side of which is provided with a suspension means, while the other three sides have a rip-away weakening line.

One embodiment of the invention has been found particularly satisfactory in that the material of the cover softens at the temperature of a small fire. The advantage of this is that the said cover adapts more readily to the fire, thus cutting off the supply of oxygen more effectively.

The effect of the cover contained in the fire-protection set is improved if, according to another embodiment of the invention, it is provided with a flame-resistant agent which cuts off the supply of oxygen. Preferred flame-resistant agents are those which, upon burning, release nitrogen, since nitrogen is chemically inert, non-toxic, and therefore produces no unwanted or harmful side-effects. In this connection, special preference is given to nitrogen-containing phosphonates, because of the synergistic effect of organically combined nitrogen and organically combined phosphorus.

One embodiment of the invention comprises an arrangement of the gripping tapes which obliges the user to grip the loops of he wishes to open the container and remove the fire-protection cover. Using the said loops improves the user's grip and assists in ripping the container open.

Folding the fire-protection cover as indicated in other embodiments of the invention ensures, on the one hand, that the said cover can be folded into the smallest possible space and that the set, because of its small bulk, remains readily available and, on the other hand, that the cover contained in the set can be unfolded in case of need without any difficulty and without loss of time.

Fitting the suspension means to the narrow side of the container, so that the fire-protection set takes up less room laterally, always makes it possible to find a suitable place to hang the set up in the vicinity of potential sources of fire.

The relevant weakening lines may be in the form of perforations in the container or intentionally weak weld-seams in the case of a plastic container.

Possible uses for the fire-protection set are almost unlimited, for example, in the home, especially in the kitchen, during leisure time activities for extinguishing open fires and barbecues, for extinguishing carburetor fires in automobiles, and fires in workshops. In such cases, the fire-protection cover may be used not only to extinguish small fires, but also to protect persons and objects from the effects of heat.

Embodiments of the invention are described hereafter in connection with the drawings wherein.

Figure 1:
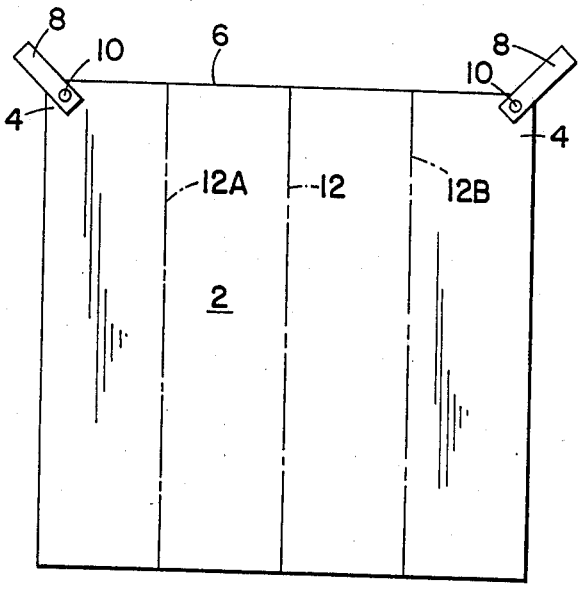
FIG. 1 is a plan view of a first fire-proof cover with fold lines.

FIG. 1 shows a square fire-proof cover 2, for example of one square meter size, which is provided with handling bands at the corners 4 adjoining the upper edge 6. These handling bands 8 are permanently connected with the fire-proof cover by means, for example, of heat seals 10, gluing, sewing, riveting or the like. Fold lines 12, 12A and 12B which are spaced uniformly from one another extend perpendicular to the upper edge 6.

Figure 2:
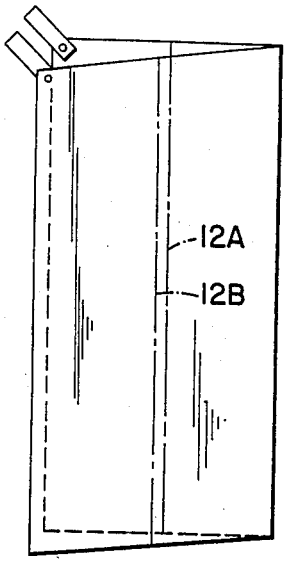
FIGS. 2 to 4 are views showing sequentially the folding steps for the fire-proof cover of FIG. 1.
Figure 3:
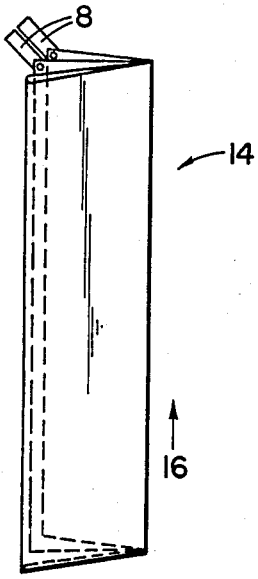
Figure 4:
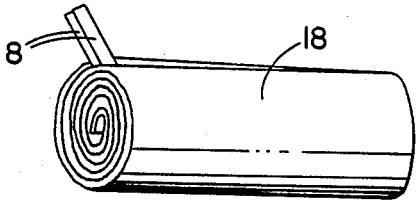

In a first folding step, according to FIG. 2, the fire-proof cover is folded along the middle fold line 12 to half of its original size. In the second folding step the fire-proof cover is folded along its now superimposed fold lines 12A and 12B to a quarter of its original size. The strip 14 so formed is then rolled up from the side opposite from the handling bands 8 in the longitudinal direction 16 into a packet 18, so that the hanlding bands 18 lie on the outside of the packet as shown in FIG. 4.

The fire-proof cover 2 as so folded and rolled into the packet 18 is inserted in a package 20 and forms together with this a fire protecting set. The packet 18 moreover is so inserted in the package 120 that the handling bands 18 protrude out of the package 20. The free ends 22 of the handling bands 8 are fastened to the outside of the package 20, for example by gluing or heat sealing or the like, so that they can easily be disconnected. The package 20 is provided with weakening lines 24 on three sides which are formed by an easily separable heat sealing of the outer sides of the package along the edges or through the use of perforations or the like. The package 20 moreover is provided with a hanging device 26 on one of its longitudinal sides, by means of which device the fire protecting set may be hung up. The hanging device 26 can also carry usage instructions.

Figure 6:
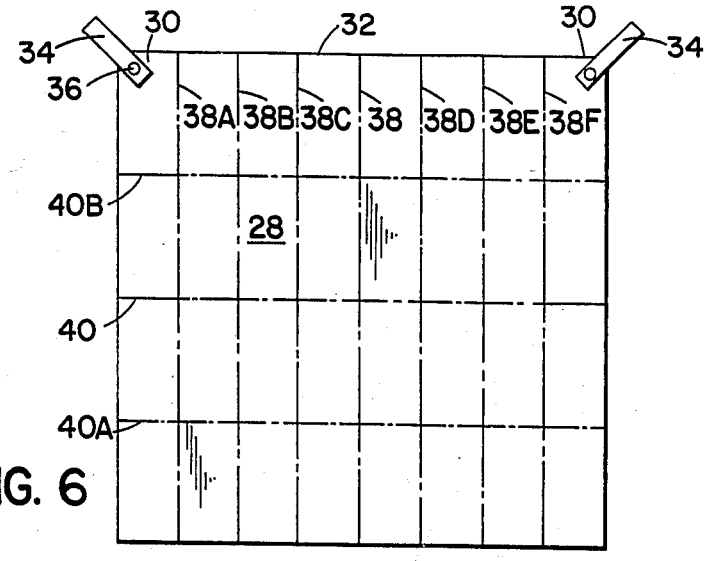
FIG. 6 is a plan view showing a second fire-proof cover with fold lines.

FIG. 6 shows a further fire-proof cover 28 which again is provided with handling bands 34 at the corners 30 adjoining the upper edge 32 and which, for example, are fastened by means of a heat seal 36. Seven fold lines 38, 38A, 38B, 38C, 38D, 38E, 38F, run perpendicular to the upper edge 32. Further, three fold lines 40, 40A and 40B are provided parallel to the upper edge 32.

Figure 7:
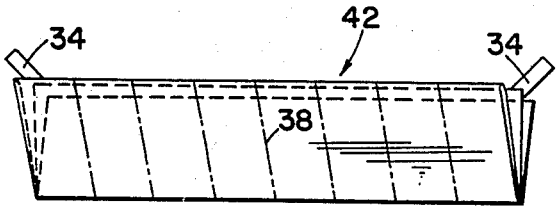
FIGS. 7 to 9 are views showing sequentially the folding steps for the fire-proof cover of FIG. 6.
Figure 8:
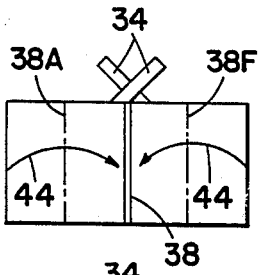

The fire-proof cover 28 is first folded in half along the middle fold line 40 which is positioned parallel to the upper edge 32. In a further folding step the fireproof cover is folded into a quarter along the now superimposed fold lines 40A and 40B so that the handling bands 34 lie inwardly, as shown in FIG. 7. The strip 42 so formed is then so laid together in a further folding step that the edges carrying the handling bands 34 lie at the transverse middle line, which coincides with the middle fold line 38, running perpendicular to the upper edge 32. Then the outer parts of the strip are folded inwardly from the sides according to the fold arrows 44 of FIG. 8. In a last folding step the two partial packets 46, 48 are moved rearwardly in accordance with the fold arrows 50 so that the partial packets 46, 48 lie back to back. With this folding method the handling bands 34 lie within the resulting packet.

Figure 10:
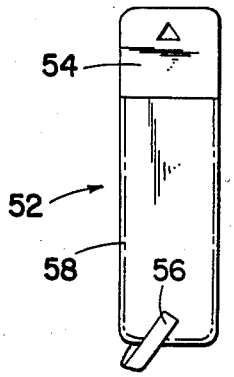
FIG. 10 is a view showing a fire-proof set including the fire-proof cover of FIG. 6.
Figure 9:
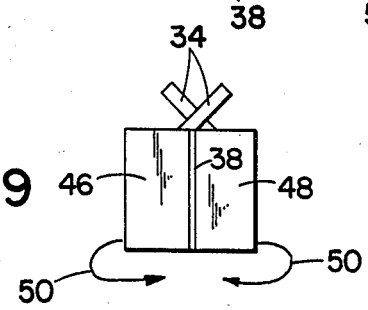

The resulting packet 46, 48 is again assembled with a package 52 into a fire-proof set. In the case of this fire-proof set, which is shown in FIG. 10, a short side of the package 52 is provided with a hanging device 54. On the short side of the package opposite from the hanging device the handling bands 34 are let out and have their ends 56 again releasably connected to the outer side of the package. With the exception of the short side to which the hanging device 54 is applied, the package 52 has lines of weakening 58, in the form of lightly heat sealed lines or perforated lines, along which the package 52 can be torn open.

The number and type of transverse and longitudinal folds can be varied in accordance with the size of the fire-proof cover and the smallness of the packet.

Figure 5:
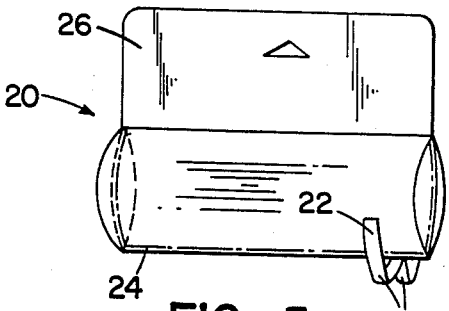
FIG. 5 is a view showing a fire-proof set including the fire-proof cover of FIG. 1.
Figure 11:
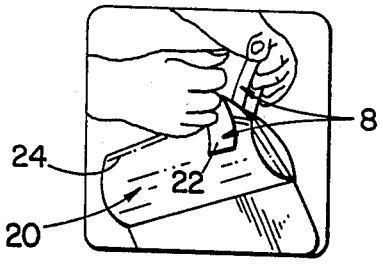
FIGS. 11 to 15 are views showing the use of a fire-proof cover for extinguishing a small stove fire.
Figure 12:
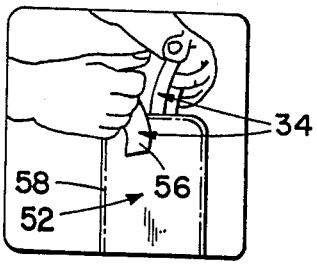
Figure 13:
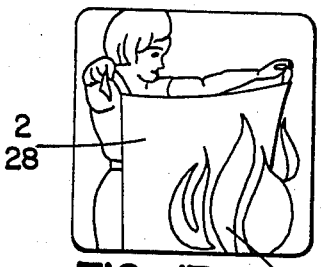
Figure 14:
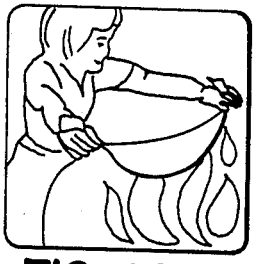
Figure 15:
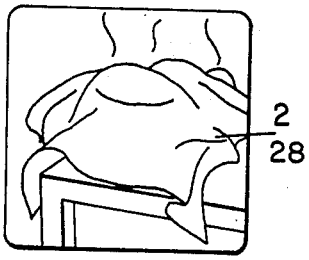

The use of the fire-proof cover is represented in detail in FIGS. 11 to 15. In these figures FIG. 11 shows the use of the fire-proof set of FIG. 5 and FIG. 12 the use of the fire-proof set of FIG. 10. The fire-proof set is opened by gripping the handling bands 8, 34 and ripping open the package 20, 52 along the weakened lines 24, 58 by means of a corresponding pull. In doing so the connection of the ends 22, 56 of the handling bands 8, 34 to the package 20, 52 is also released. The package falls to the floor and the fire-proof cover 2, 28 can be unfolded to a useful condition in a matter of seconds in which condition it next protects its user from the heat of the fire. The fire-proof cover 2, 28 is then thrown over the fire 60 and smothers it. If the fire-proof cover is made of a material which softens at the temperature of the fire, it will nestle close to the fire so that the supply of oxygen is further reduced.

As materials for the fire-proof cover ones such as have high melting temperatures, are flame-proof, and are at least almost gas-tight, come into consideration. Included in these are foils and textiles, in which case the textiles can be made of flame-proof materials or can be impregnated or covered with a layer of a flame-proofing agent. By flame-proof it is to be understood that the materials are not combustible or are self-extinguishing. As examples of suitable materials the following can be named: metal foils, preferably aluminum foils which can be provided with a reinforcement, for example a glass fiber reinforcing fiber textile, metal textiles, textiles made of fibers provided with a layer of metal, asbestos textiles, and glass thread textiles, preferably textiles of glass fibers or glass fiber roving.

If a textile is used, it is an advantage for it to have a good heat insulating quality since in this way persons and objects located in the vicinity of a fire are protected from the effect of the heat. This is especially important in cases where easily ignitable materials are located in the vicinity of the fire. Because of the screening provided by the heat insulating properties, the ignition temperature of the easily ignitable materials will not be reached and thereby a widening of the fire will be prevented.

Along with the named foils and textiles made of nonflammable materials such as metal, asbestos and glass fibers, textiles made of combustible materials and which are equipped with a flame-proofing or flame inhibiting agent also come into consideration. By processing with a flame-proofing agent, for example by impregnating or layering, the combustibility of the textile can be overcome or at least reduced. Moreover, by proper choice of the flame-proofing agent the textile in question can be made so that although ignitable it is nevertheless self-extinguishing.

Especially advantageous are impregnations or layerings with flame-proofing agents with oxygen excluding properties, especially such which at the temperature of the fire release gases or vapors which smother the flames. Included in this are nonpermanent flame-proofing agents, preferably nitrogen containing phosphonate which at the fire temperature is decomposed with the release of nitrogen.

In accordance with a preferred construction the fire-proof cover is made of a glass thread textile preferably made of glass fibers or glass fiber roving. In this case the glass fibers preferably consist of a glass whose transformation temperature $T_g$ is about 1250 degrees Centrigrade and which exhibits a softening interval of several hundred degrees Centrigrade, preferably from 850 degrees Centrigrade to 1250 degrees Centrigrade. By the use of glass fibers made of glass with a transformation temperature of 1250 degrees Centrigrade, it is assured that the textile manufactured from it will not melt at the temperatures produced by a small fire. Since a softening of the glass fibers begins already at several hundred degrees below the transformation temperature the flexibility of the glass fiber textile increases with increases in temperature from the softening temperature. In this way the entrance of air or oxygen is choked off even at those places which are not originally tightly sealed upon the application of the cover because of its folds.

The glass fiber textile from which the fire-proof cover is made preferably has an areal weight of about 200 g/m$^2$. Textiles with such areal density generally exhibit a sufficient resistance to the passage of air or oxygen to choke off a fire. Also, a supplementary sealing can be achieved by a layer making the textile gas impermeable. A further improvement of the suffocating effect of the described fire-proof cover can be achieved by an impregnation or layering of it with a nonpermanent flame-proofing agent.

Since upon cutting of a fire-proof cover made of glass fibers open cut edges are formed which can lead to fraying of the textile and/or injury to the user, the cut textile is best provided with an edge seal. The edge seal can be made in such a way that a band-shaped thermoplastic material, for example a nylon band, is applied along the cut edges of the textile by means of a heat effected fusion. In this way a fraying of the cut glass fiber textile is prevented and the danger of injury is reduced.

I claim:

1. A fire protecting set comprising a rectangular fire-proof cover having horizontal and vertical dimensions and having an upper edge and two adjoining upper corners, said cover being provided with two handling bands each attached to said cover at a point adjacent said upper edge of said cover adjacent an associated one of said two upper corners of said cover, said cover being made of a substantially gas-tight glass fiber textile and being so folded as to form a packet in which said handling bands are located adjacent to one another and such that when said handling bands are pulled apart as far as possible said cover is immediately spread to its full horizontal dimension without the need for any other manipulation of said cover or said bands, and a bag-like package containing said packet, said package being of generally rectangular shape with four sides, said package having a hanging device attached to it adjacent one of its sides and having a tearable line of weakening extending along three of said sides, said handling bands extending through said package at one point along said tearable line of weakening so as to be graspable by a user from outside of said package, the spreading of said bands and said cover when said bands are grasped and pulled apart causing said package to tear along said line of weakening to separate said cover from said package without any holding force having to be applied to said package, said cover being made of glass fiber roving with the glass fibers of said roving consisting of a glass whose transformation temperature $T_g$ is about 1250 degrees Centigrade and which has a softening interval of several hundred degrees Centigrade, preferably from 850 degrees Centrigrade to 1250 degrees Centigrade.

2. A fire protecting set according to claim 1, further characterized in that said fire-proof cover is provided with an oxygen isolating flame-proofing agent including a nitrogen containing phosphonate which releases nitrogen at the temperature of a stove fire.

3. A fire protecting set according to claim 1, further characterized in that said handling bands are formed as loops.

4. A fire protecting set according to claim 1, further characterized in that said fire-proof cover in forming said packet is first folded along several fold lines running parallel to the edge to which the handling bands are fastened to form a strip, and in that said strip is then folded symmetrically to its transverse middle line from both sides toward said transverse middle line.

5. A fire protecting set according to claim 4 further characterized in that in folding said strip the sides of said strip which carry said handling bands are first folded toward the transverse middle line to cause the handling bands to lie on said transverse middle line whereupon the so folded strip is folded from both sides toward said transverse middle line to form two partial packets, said two partial packets being moved so that they lie back to back.

* * * * *